US006647739B1

(12) United States Patent
Kim et al.

(10) Patent No.: US 6,647,739 B1
(45) Date of Patent: Nov. 18, 2003

(54) ICE MAKING MACHINE

(75) Inventors: Oh-bok Kim, Gwangju (KR); Hideo Nakajo, Kimpo (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 10/411,768

(22) Filed: Apr. 11, 2003

(30) Foreign Application Priority Data

Oct. 31, 2002 (KR) ..... 10-2002-0066738

(51) Int. Cl.[7] ..... F25C 5/10
(52) U.S. Cl. ..... 62/352
(58) Field of Search ..... 62/352, 340, 349, 62/233, 345, 68

(56) References Cited

U.S. PATENT DOCUMENTS 4,602,489 A * 7/1986 Hara ..... 62/320
4,619,117 A * 10/1986 Ito ..... 62/233
4,910,974 A * 3/1990 Hara ..... 62/347
4,924,678 A * 5/1990 Ito ..... 62/138
4,932,216 A * 6/1990 Ito ..... 62/129
5,025,637 A * 6/1991 Hara ..... 62/138
5,425,243 A * 6/1995 Sanuki et al. ..... 62/138
6,101,833 A * 8/2000 Suzuki ..... 62/340
6,357,720 B1 * 3/2002 Shapiro et al. ..... 249/119

FOREIGN PATENT DOCUMENTS

EP 1209428 A1 * 5/2002
JP 409079713 A * 3/1997

* cited by examiner

*Primary Examiner*—William E. Tapolcai
*Assistant Examiner*—Mohammad M. Ali
(74) *Attorney, Agent, or Firm*—Ladas & Parry

(57) ABSTRACT

An ice making machine comprising a housing, an evaporator connected to a freezing system, a base frame having a lower surface and a multiplicity of freezing cells for retaining water to be frozen, a freezing base plate provided adjacent to the evaporator and the freezing base plate having freezing fingers formed on the lower surface of the freezing base plate to be dipped into the water retained by the freezing cells, and an ultrasonic transducer for removing air bubbles inside the water by vibrating the water contained in the freezing cells with ultrasonic waves. The ultrasonic transducer preferably is disposed on the lower surface of the base frame.

2 Claims, 4 Drawing Sheets

ICE MAKING MACHINE

BACKGROUND OF THE INVENTION

1. Field of the Invention

The present invention relates generally to an ice making machine, and more particularly, to an ice making machine enabled to reduce ice making time and minimize the amount of water being wasted.

2. Description of the Background Art

An ice making machine is an apparatus for making pieces of ice by freezing water supplied from an external water supply. Recently, ice making machines have been proposed that enable the prevention of opacification of ice pieces, which occurs as air bubbles inside the water are frozen.

FIGS. 1 and 2 show a conventional ice making machine disclosed in U.S. Pat. No. 5,425,243. The conventional ice making machine, as shown in FIGS. 1 and 2, comprises a housing 10, a freezing unit 20, and an air removing means 30.

The housing 10 of the ice making machine comprises an ice bin 11 for storing pieces of ice produced by the freezing unit 20. A compressor 12 and a condenser 13 are disposed below the ice bin 11 within the housing 10.

The freezing unit 20 comprises a water tray 21, a freezing base plate 22, and an evaporator 23 as shown in FIG. 2. The water tray 21 is filled with water. A multiplicity of freezing fingers 24 are formed on the lower surface of the freezing base plate 22 for being dipped into the water to be frozen. A pivoting means 25 is disposed at one side of the water tray 21 for tilting the water tray 21 and discharging the water, which has not frozen and does not form ice pieces. The evaporator 23 is disposed on the upper surface of the freezing base plate 22 and is connected with a freezing system 12,13. Refrigerant flows inside the evaporator 23 to cool the freezing base plate 22 and the freezing fingers 24 by the heat exchange of the refrigerant.

The air removing means 30 for preventing opacification from occurring during the ice making process by removing air bubbles in the water to be frozen comprises a rocking plate 31 that rocks up and down inside the water tray 21, is and a rocking motor 32 for rocking the rocking plate 31. When an engagement piece 33 disposed in the rocking motor 32 hits an engagement pin 34, the rocking plate 31 rocks, thereby floating the air bubbles upwardly and outside the water.

The freezing unit 20 further includes a water supply pipe 14, a pivotal shaft 26, a water chute 27, and a water collecting section 15.

Hereinafter, the operation of a conventional ice making machine having the above structure is described.

When the water is supplied to the water tray 21 through the water supply pipe 14 and the freezing fingers 24 are dipped into the water, the water starts to form ice around the freezing fingers 24 cooled below the freezing point by heat exchange of the refrigerant flowing inside the evaporator 23. At the same time, the rocking plate 31 disposed under the water rocks up and down as the rocking motor 32 is driven. Accordingly, the air bubbles inside the water are removed and clear ice pieces are gradually formed around the freezing fingers 24.

After ice pieces having a predetermined size are formed around the freezing fingers 24, the rocking plate 31 stops rocking, and hot gas is discharged from the compressor 12 directly into the evaporator 23 without passing through the condenser 13, thereby warming the freezing fingers 24.

The water tray 21 is tilted on the pivotal shaft 26 by the pivoting means 25. Therefore, the ice pieces are separated from the freezing fingers 24, and drop into the ice bin 11, and the water remaining in the water tray 21 is discharged into the water collecting section 15 by flowing through the water chute 27.

Such conventional ice making machines require an amount of water exceeding what is actually to be frozen, as the water tray is designed to hold more than the amount of water necessary to make ice pieces, thereby wasting a lot of water that is guided into the water collecting section 15.

Moreover, since the freezing fingers 24 cool not only the water to be frozen but also the whole water in the water tray 21, excessive energy is consumed unnecessarily prolonging the time required to freeze the water around the freezing fingers 24.

SUMMARY OF THE INVENTION

An object of the invention is to solve at least the above problems and/or disadvantages and to provide at least the advantages described hereinafter.

Accordingly, an object of the present invention is to solve the foregoing problems by providing an ice making machine capable of minimizing the waste of water by supplying a predetermined amount of water into a multiplicity of freezing cells formed having a predetermined size and of shortening the time required to form ice pieces by increasing the freezing rate at which the ice freezes around the freezing fingers.

In order to achieve the above objectives, the ice making machine according to present invention comprises a housing, an evaporator connected to a freezing system, a base frame having a lower surface and a multiplicity of freezing cells for containing water to be frozen, a freezing base plate provided adjacent the evaporator and having freezing fingers formed on the lower surface of the freezing base plate to be dipped into the water retained by the freezing cells, and an ultrasonic transducer for removing air bubbles inside the water by vibrating the water contained in the freezing cells with ultrasonic waves.

The ultrasonic transducer preferably is disposed on the lower surface of the base frame.

BRIEF DESCRIPTION OF THE DRAWINGS

The above objects and the features of the present invention will be made more apparent by describing a preferred embodiment of the present invention with reference to the accompanying drawings, in which.

DETAILED DESCRIPTION OF THE PREFERRED EMBODIMENT

Figure 1:
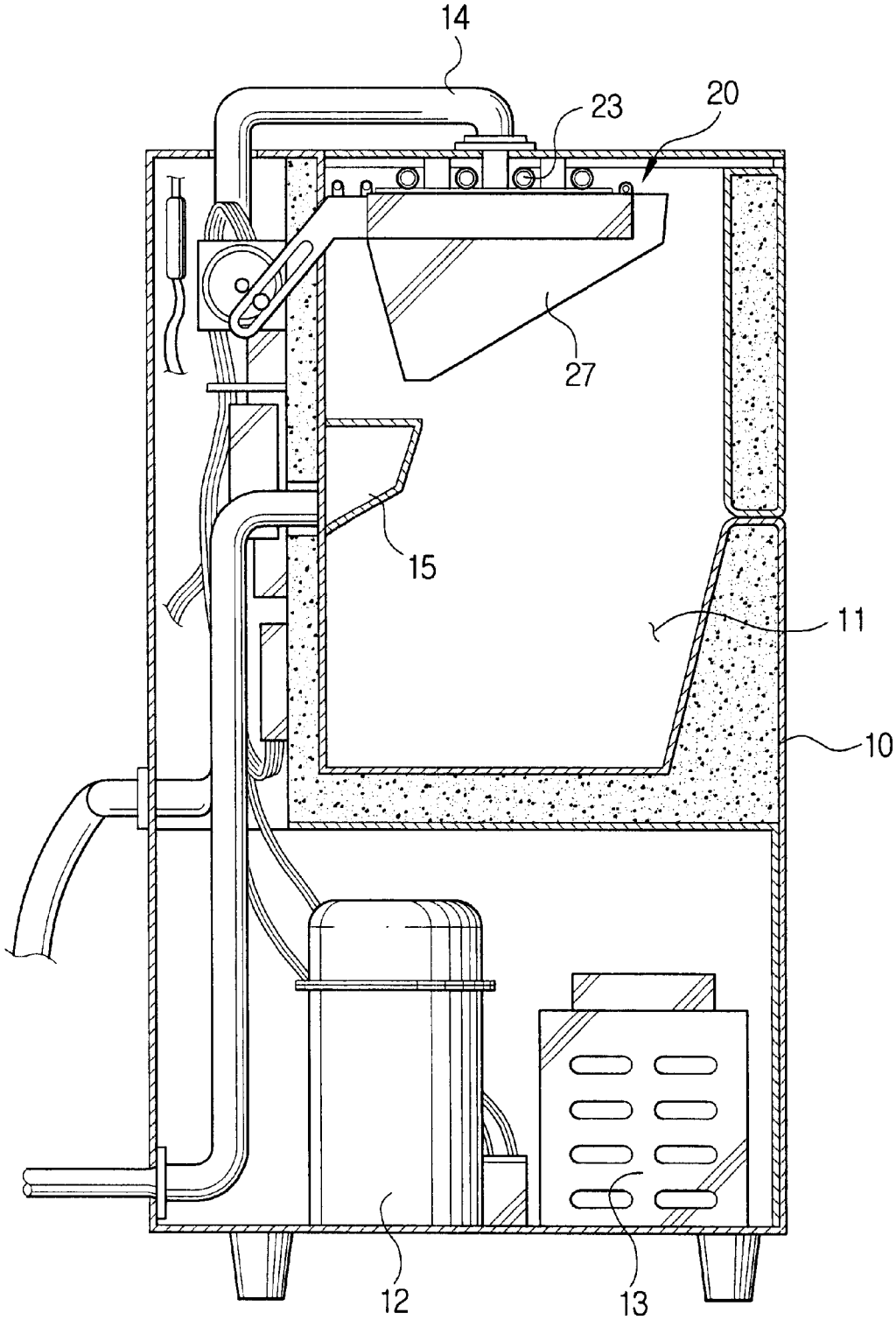
FIG. 1 (PRIOR ART)
FIG. 1 is a cross-sectional view showing the structure of a conventional ice making machine.
Figure 2:
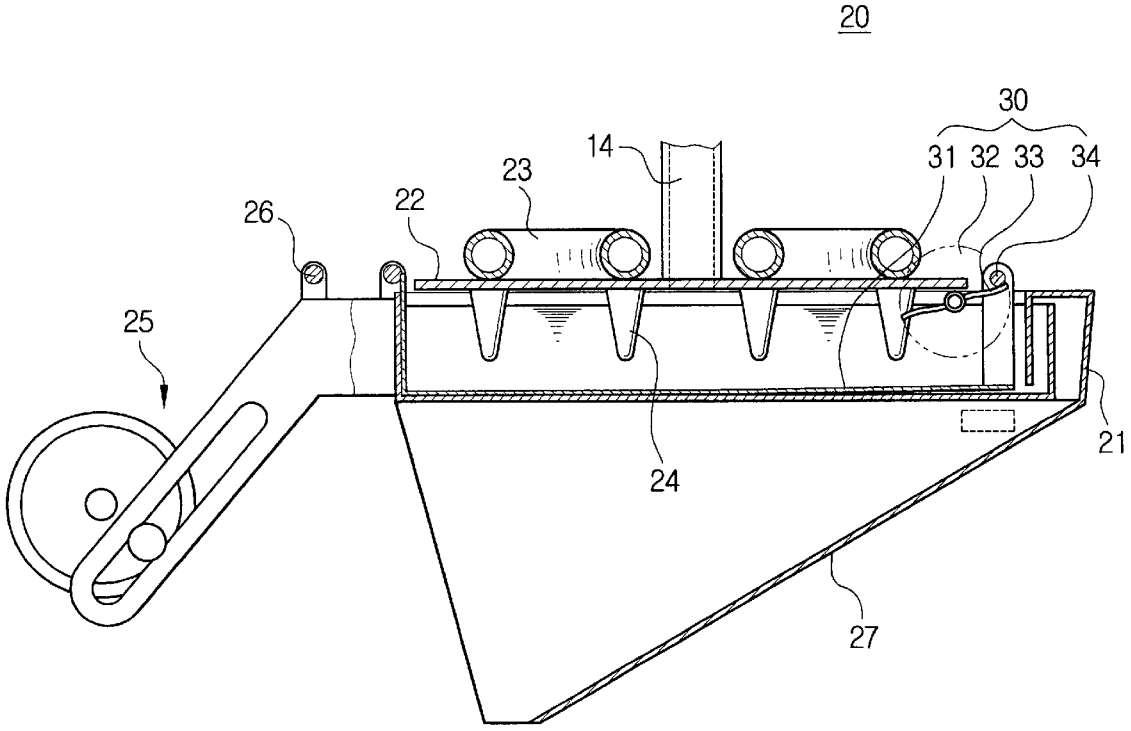
FIG.2 (PRIOR ART)
FIG. 2 is a side view showing an essential element of the conventional ice making machine shown in FIG. 1.

Hereinafter, an ice-making machine according to a preferred embodiment of the present invention will be described in greater detail with reference to the accompanying drawings. With respect to the elements that are identical to those of the prior art device shown in FIGS. 1 and 2, like reference numerals will be assigned thereto.

Figure 3:
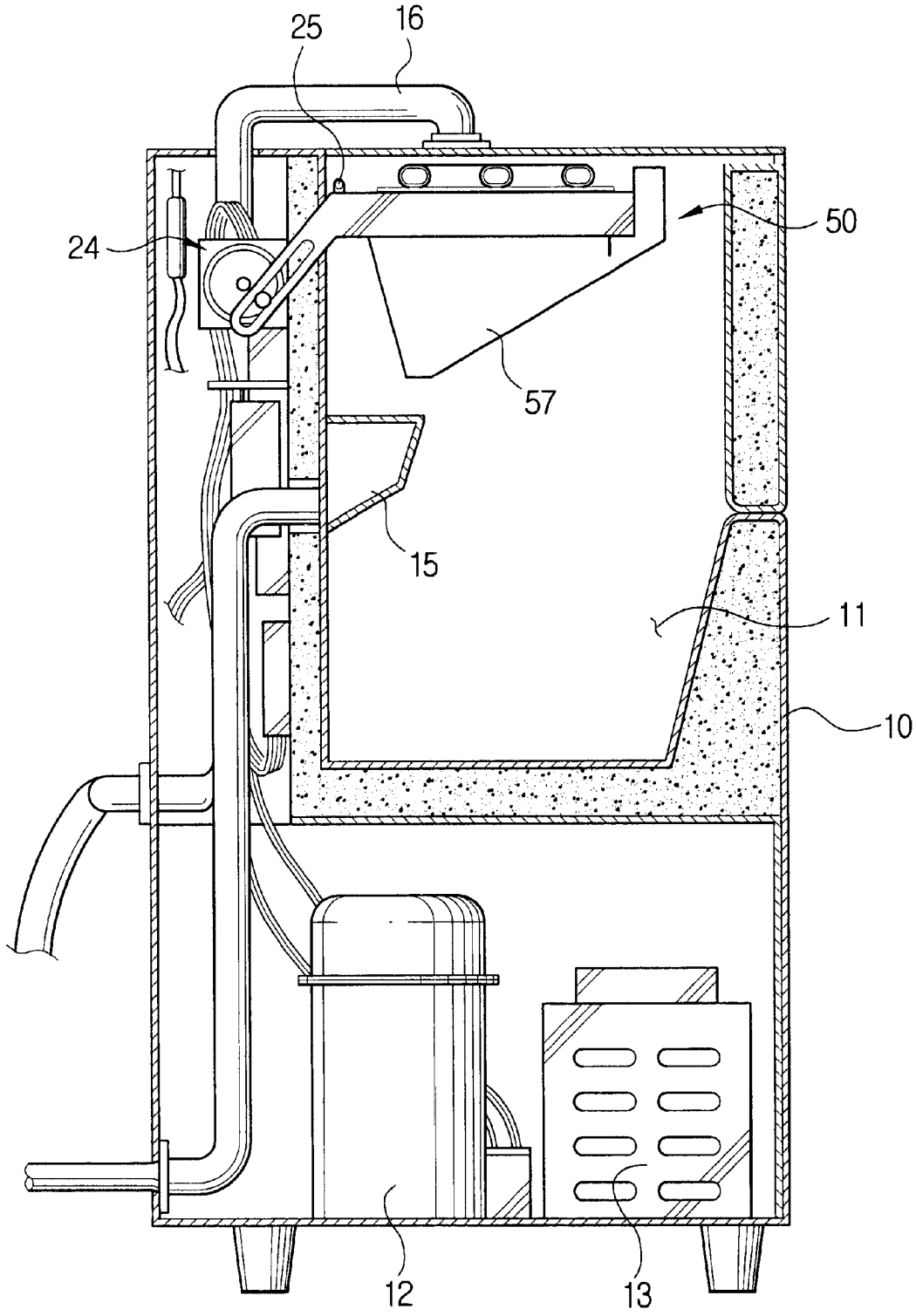
FIG. 3 is a cross-sectional view showing the structure of an ice making machine according to a preferred embodiment of the present invention.
Figure 4:
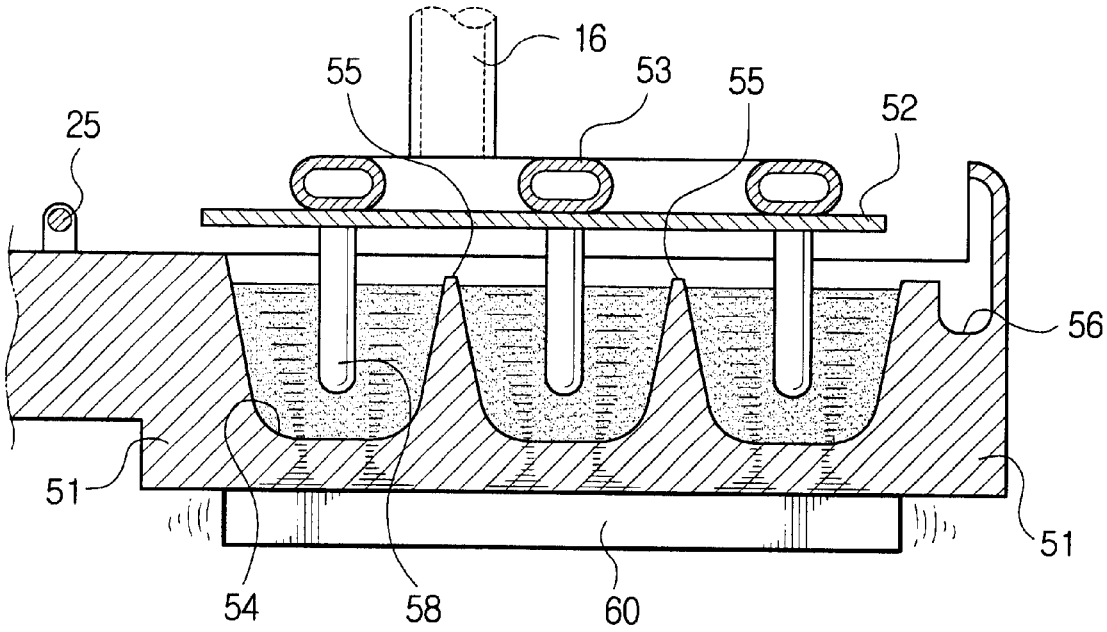
FIG. 4 is a cross-sectional view showing an essential element of the conventional ice making machine shown in FIG. 3.

As shown in FIGS. 3 and 4, the ice making machine according to the present invention comprises a housing 10, a freezing unit 50, and an ultrasonic transducer 60.

The housing 10 has an ice bin 11 for storing ice pieces produced by the freezing unit 50. A compressor 12 and a condenser 13, comprising a freezing system, are disposed underneath the ice bin 11 and a water collecting section 15 is disposed at a side of the ice bin 11, for discharging the remaining excess water.

The freezing unit 50 comprises a base frame 51, a freezing base plate 52 and an evaporator 53. The base frame 51 is pivotably disposed on the housing 10 and has a multiplicity of freezing cells 54 into which water is permitted to flow.

The freezing cells 54 are disposed on and within the base frame 51, and are shaped and dimensioned to each form an inverted dome-shape with the diameter narrowing towards the bottom, as shown in FIG. 4. The number of the freezing cells may range between 20 and 30, and preferably are about 27, depending on the cooling capacity of the freezing system. Between the freezing cells are provided connecting grooves 55 for water to flow. The water supplied from a water supply pipe 16 fills one of the freezing cells 54 and then continuously flows into the next freezing cell 54 through the connecting groove 55, until all of the freezing cells 54 are filled with water at essentially the same level.

At a side of the base frame 51, a drain path 56 is formed. When the base frame 51 is tilted in a predetermined angle around a pivotal shaft 25 by a pivoting means 24, the unfrozen water remaining in the freezing cell 54 flows into a water chute 57 in fluid communication with the drain path 56 and is discharged into the water collecting section 15.

The freezing base plate 52 is disposed under the evaporator 53 and the freezing fingers 58 are dipped into the water supplied within the freezing cells 54, which are disposed under the freezing base plate 52. The evaporator 53 is connected with the freezing system 12,13 allowing refrigerant to flow therethrough. The freezing fingers 58 are cooled below the freezing point by the heat exchange of the refrigerant flowing inside the evaporator 53, and ice pieces are gradually formed around the freezing fingers 58.

The ultrasonic transducer 60 is disposed under the base frame 51 and vibrates the water contained in the freezing cells 54 up and down by generating ultrasonic waves so that the air bubbles inside the water float upwardly and outside the water.

Hereinafter, the operation of an ice making machine according to the present invention is described. When a predetermined amount of water is supplied from the water supply pipe 16, the water fills the freezing cell 54 underneath the water supply pipe 16 and then subsequently flows into the adjoining freezing cells 54 through the connecting groove 55, thereby filling water in all the freezing cells 54 to the same level.

After the water supply is completed, the water around the freezing fingers 58 is cooled below the freezing point by the heat exchange of the refrigerant inside the evaporator and starts to form ice. At the same time, the ultrasonic transducer generates ultrasonic waves and the waves vibrate the water contained in the freezing cells 54 thereby floating the air bubbles upwardly and outside the water. Therefore, water with air bubbles removed freezes around the freezing fingers 58, thus forming clear ice pieces.

While the ice pieces form around the freezing fingers 58, the ultrasonic transducer 60 keeps generating ultrasonic waves in the freezing cells 54 so that the operation of removing air bubbles from the water to be frozen continues until ice pieces having a predetermined size form around the freezing fingers 58. When the predetermined size of ice pieces is obtained by formation around the freezing fingers 58, the ultrasonic transducer 60 stops operating and the base frame 51 is tilted by the pivoting means 24on the pivotal shaft 25. Since most of the water supplied in the freezing cells 54 is frozen when the base frame 51 is tilted, only a small amount of unfrozen water is guided to the water chute 57 along the drain path 56 and is then discharged into the water collecting section 15.

Meanwhile, hot gas from the compressor 12 flows directly into the evaporator 53, bypassing the condenser 13. Accordingly, the freezing fingers 58 are warmed up to around 10° C., allowing the ice pieces to be separated from the freezing fingers 58 and to thereby drop into the ice bin 11.

According to the present invention, in which a predetermined amount of water is supplied into a multiplicity of freezing cells 54 formed having a predetermined size, the amount of water supplied for ice making can be reduced compared to the conventional ice making machine, thereby preventing water from being wasted.

Another advantage of the present invention is that the freezing rate around the freezing fingers 58 can be improved, thereby reducing ice making time, as the freezing fingers 58 cooled below the freezing point are dipped into a predetermined amount of water carried in the freezing cells 54, which will permit all of the water in each cell 54 to freeze at about the same time.

The foregoing embodiments and advantages are merely exemplary and are not to be construed as limiting the present invention. The teaching of the present invention can be readily applied to other types of apparatuses. The description of the present invention is intended to be illustrative, and not to limit the scope of the following claims. Many alternatives, modifications, and variations will become apparent to those skilled in the art. In the claims, means-plus-function clauses are intended to cover the structures described herein as performing the recited function and not only structural equivalents but also equivalent structures.

What is claimed is:

1. An ice making machine comprising:

a housing;

an evaporator connected to a freezing system;

a base frame having a lower surface and a multiplicity of freezing cells for retaining water to be frozen;

a freezing base plate provided with adjacent the evaporator, the freezing base plate having freezing fingers formed on the lower surface of the freezing base plate to be dipped into the water retained by the freezing cells; and an ultrasonic transducer for removing air bubbles inside the water by vibrating the water contained in the freezing cells with ultrasonic waves.

2. The ice making machine according to claim 1 wherein the ultrasonic transducer is disposed on the lower surface of the base frame.

* * * * *